United States Patent [19]

Soures et al.

[11] 4,017,067

[45] Apr. 12, 1977

[54] TRANSFER-FUSING SPEED COMPENSATION

[75] Inventors: Nicholas M. Soures, Penfield; James W. Patterson, Sodus; Wayne C. Powley, Lyons, all of N.Y.

[73] Assignee: Xerox Corporation, Stamford, Conn.

[22] Filed: July 20, 1976

[21] Appl. No.: 706,996

[52] U.S. Cl. ..... 271/80; 118/60; 226/118; 271/194; 271/270; 271/DIG. 2; 355/3 R; 432/60

[51] Int. Cl.[2] ..... B65H 29/24; B65H 29/54

[58] Field of Search ..... 271/80, 174, DIG. 2, 271/202, 270, 194; 355/3 R, 5 R, 13; 432/60; 118/60, 245; 226/118

[56] References Cited

UNITED STATES PATENTS

| | | | |
|---|---|---|---|
| 3,499,614 | 3/1970 | Badum | 226/118 X |
| 3,578,859 | 5/1971 | Stillings | 271/80 X |
| 3,743,154 | 7/1973 | Brewite | 226/118 X |
| 3,774,907 | 11/1973 | Borostyan | 271/80 |
| 3,863,913 | 2/1975 | Hirafuji | 271/80 X |

*Primary Examiner*—Evon C. Blunk
*Assistant Examiner*—Bruce H. Stoner, Jr.

[57] ABSTRACT

In an electrostatographic copier wherein the fuser rolls are positioned closer than the dimensions of the copy sheet from the image transfer area, speed mismatch compensation between the fuser roll nip and the initial image support surface is provided by intentionally driving the fuser roll nip at a different pre-set velocity to form a buckle in the intermediate portion of the copy sheet controlled by selective cyclic reductions in the vacuum applied to a vacuum chamber sheet guide surface between the fuser nip and the initial image support surface, wherein the vacuum guide is in two areas, one of which is provided with a vacuum by the other, but is cyclically atmospherically vented.

6 Claims, 3 Drawing Figures

TRANSFER-FUSING SPEED COMPENSATION

The present invention relates to electrostatographic copying with compensation for variations between the velocity of the initial image support surface and the velocity of the copy sheet with its removal therefrom.

Common subject matter is disclosed in the following U.S. Patent applications of the same title and assignee: Ser. No. 681,309, filed Apr. 1976, by Raymond E. Poehlein, and Ser. No. 687,439 filed May 1976, by Thomas Skaper and David P. VanBortel.

In a transfer electrostatographic process such as conventional transfer xerography, in which an image pattern of dry particulate unfused toner material is transferred to a final image support surface, e.g., a copy sheet from an initial image bearing surface, e.g., a charged photoreceptor surface developed with toner, the transferred toner is typically only loosely adhered to the final support surface after transfer, and is easily disturbed by the process of stripping the final support surface away from the initial support surface and by the process of transporting the final support surface to the toner fusing station. The final support surface preferably passes through a fusing station as soon as possible after transfer so as to permanently fuse the toner image to the final support surface, thereby preventing smearing or disturbance of the toner image by mechanical agitation or electrical fields. For this reason, and also for reasons of simplifying and shortening the paper path of the copier and space savings, it is desirable to maintain the fusing station as close as possible to the transfer station. A particularly desirable fusing station is a roll type fuser, wherein the copy sheet is passed through a pressure nip between two rollers, preferably at least one of which is heated and at least one of which is resilient. An example of a xerographic transfer stripping, transporting and fusing system of this type is described in U.S. Pat. No. 3,578,859, issued May 18, 1971, to W. K. Stillings. These and the other references cited herein are hereby incorporated by reference.

However, when such a fuser roll nip for the final support surface is located close enough to the transfer station so that a lead portion of the final support surface can be in the fuser roll nip simultaneously with the rear or trailing portion of that same final support surface still being in contact with the photoreceptor, then a serious problem can arise, to which the present invention provides a solution. This problem is that of smears or skips in the unfused toner image which has been, or is being, transferred to the trailing portion of the final support surface. This condition is caused by relative movement or slippage between the initial support surface and the final support surface in those areas where they are still in contact, i.e., those areas of the final support surface which have not yet been stripped away from the initial support surface. A source of such slippage is a speed mismatch between the nip speed of the fuser rolls (the speed at which the fuser is pulling the lead edge of the paper through the fuser) relative to the surface speed of the initial support surface. If the fuser roll nip speed is slower, the final support can slip backwards relative to the initial image support surface. If the fuser roll is faster, the final support material can be pulled forward relative to the image on the initial support surface. In either case this can cause the aforementioned smears or skips in the toner image being transferred to the trailing area of the final support, or image elongation.

An exactly equal velocity drive connection between the initial support surface and the fuser rolls is difficult to maintain. Also, there is a further complication that the actual sheet driving velocity of the fuser roll nip can change with changes in the effective diameter of the driving roll in the nip. This can occur from replacement of the rollers, or changes in the resilient deformation of the rollers due to changes in the applied nip pressure, materials aging, temperature effects, etc. Thus, equal speed is difficult to maintain between the fuser roll nip and the photorecepter surface in a commercial apparatus and may require increased maintenance and speed adjustment mechanisms.

Where the spacing between the fusing station and the transfer station is greater than the dimensions of the copy sheet, and a separate two-speed sheet transport is provided therebetween, then substantially different fuser roll nip speeds can be provided, as in U.S. Pat. No. 3,794,417, issued Feb. 26, 1974, to J. A. Machmer. However, this has the noted disadvantages of requiring additional space, increased unfused image sheet handling, and also the additional complexity and expense of the additional transport mechanism.

It is known in the electrostatographic copying art to form a buckle in a copy sheet in its movement through the copier at other locations and for other functions. For example, it is known to interrupt the forward movement of a copy sheet with registration fingers and to form a buckle in the copy sheet by its continued feeding by upstream feed rollers, to provide registration of the lead edge of the copy sheet before the copy sheet is fed into the image transfer station, e.g., U.S. Pat. No. 3,601,392, issued Aug. 24, 1971, to Merton R. Spear, Jr., et al. It is also known to provide for pre-form a buckle in a web of copy material to compensate for the braking of the web during a cutting operation in which the web is cut into individual sheets, e.g., U.S. Pat. No. 3,882,744, issued May 13, 1975, to Alan F. McCarroll. The later patent also illustrates that the copy web may be preformed into an initial convex buckle over an apertured surface and that air pressure may be utilized to expand the buckle when the web is stopped downstream thereof.

U.S. Pat. No. 3,774,907, issued Nov. 27, 1973, to Stephen Borostyan illustrates a vacuum sheet stripping device for removing copy sheets from the initial image support member and advancing them to a roll fuser, wherein the copy sheets assume a convex shape. A rotating cylindrical apertured vacuum member is utilized, to which the copy sheet is attracted. During a portion of its rotation, the vacuum is automatically cutoff to the vacuum stripping member to release the copy sheet.

U.S. Pat. No. 3,508,824, issued Apr. 28, 1970, to R. K. Leinback et al. describes a conductive curved guide plate for attracting a copy sheet at the stripping area and guiding it towards a fusing station.

The present invention provides a speed mismatch compensation system which allows the fusing roll nip to be closely spaced from the transfer station of an electrostatographic copier, by a distance less than the movement dimension of an individual copy sheet, to provide the above-stated advantages of such a system, yet overcome or substantially reduce the above-stated disadvantages thereof. The intermediate portion of the copy sheet is selectively supported and guided in a manner which accommodates a speed differential between the fuser roll nip velocity and the velocity of the initial support surface. A speed variation and differential is accommodated between the leading edge and trailing edge areas of the same final image support surface, in a manner which avoids disturbance of the unfused toner image in any area thereon.

Further objects, features, and advantages of the present invention pertain to the particular apparatus, steps, and details whereby the above-mentioned aspects of the invention are attained. Accordingly, the invention will be better understood by reference to the following description of an exemplary embodiment thereof, and to the drawings forming a part of that description, which are approximately to scale, wherein.

Figure 1:
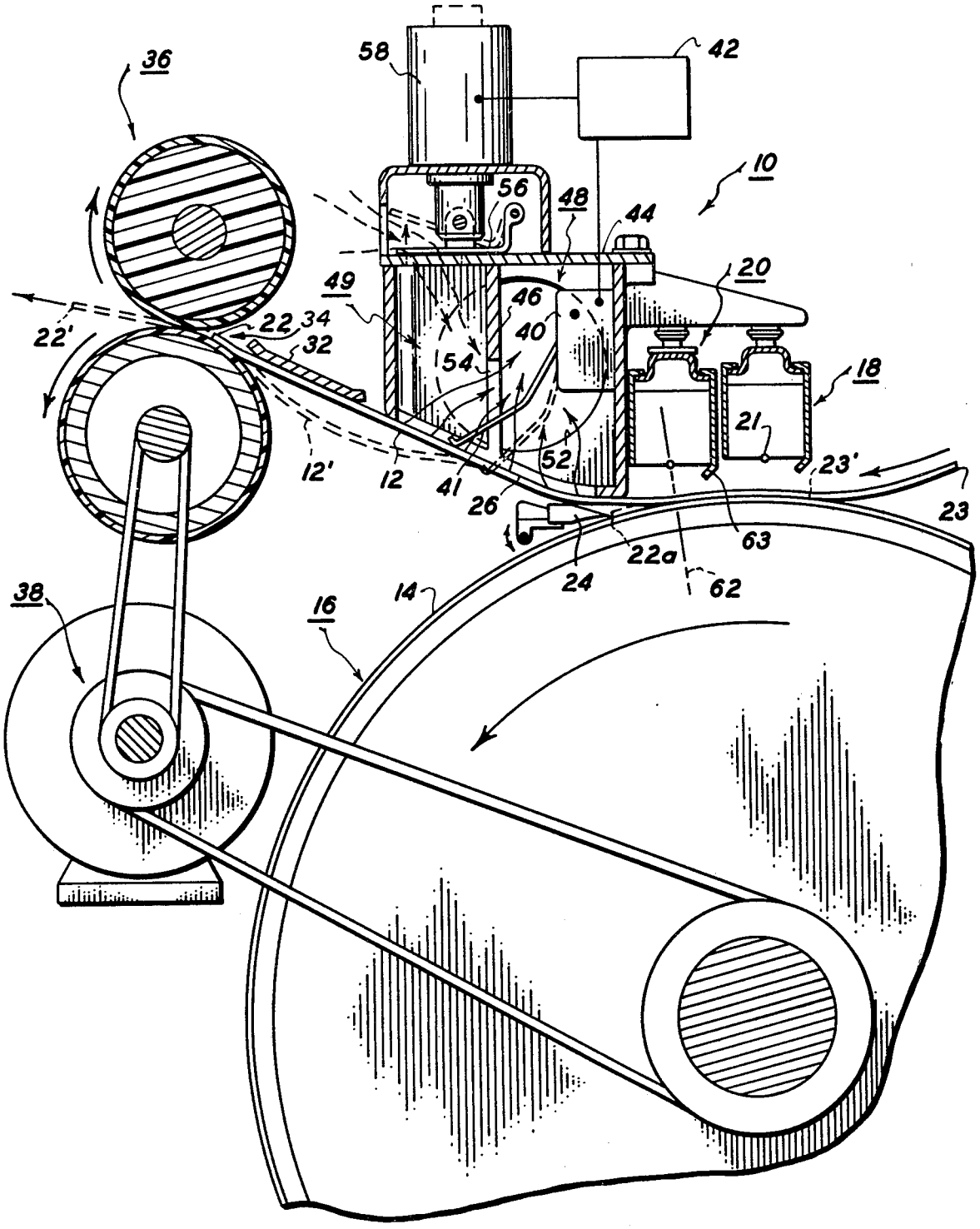
FIG. 1 is a cross-sectional side view of an exemplary xerographic copying apparatus in accordance with the present invention, illustrating those portions thereof relevant to the description of the present invention.
Figures 2, 3:
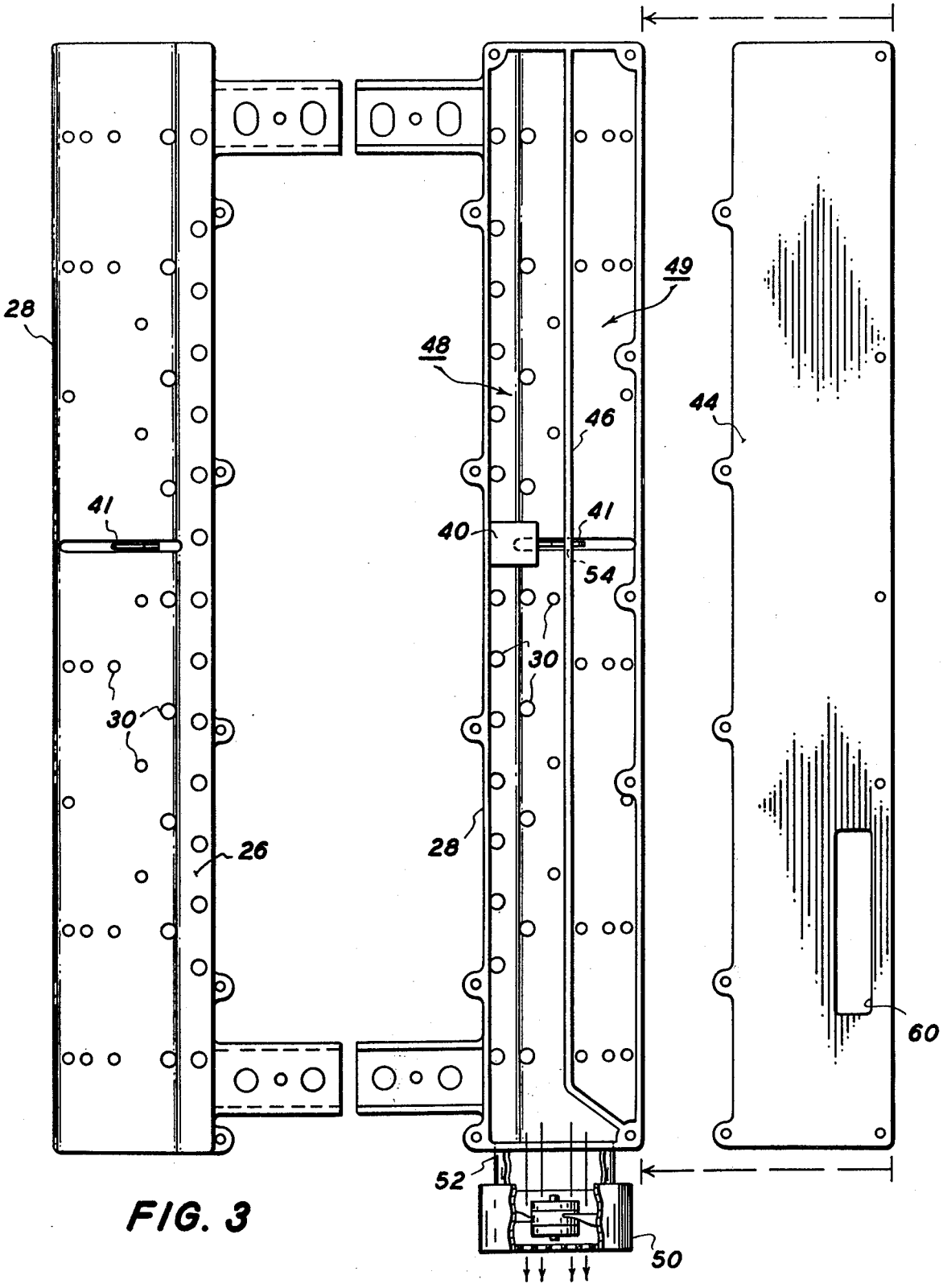
FIG. 2 is a top view of the vacuum manifold unit of the embodiment of FIG. 1, with the top cover thereof shown removed to the right side for clarity.
FIG. 3 is a bottom view of the vacuum manifold of FIGS. 1 and 2.

Referring now to the drawings, and specifically to the embodiment 10 of FIGS. 1–3, it may be seen that the xerographic transfer, stripping, vacuum manifold transport, and roll fusing system illustrated therein is generally similar in many respects to that of the Xerox 4000 and 4500 xerographic copiers. The above-cited disclosure of U.S. Pat. No. 3,578,859 or its equivalents, or other references, may be referred to for additional descriptions of examples of appropriate or conventional details of such systems. Accordingly, the following description will be directed specifically to the novel aspects of the embodiment providing the above-discussed speed mis-match compensation.

However, briefly first describing the conventional aspects of the disclosed system 10 in FIG. 1, it may be seen that a copy sheet 12 is sequentially brought into contact with, and transported at the same speed as, the initial image bearing surface 14 of a moving photoreceptor drum 16. The copy sheet 12 passes under a transfer corona generator 18 which applies electrostatic transfer charges to the back of a copy sheet and electrostatically tacks the copy sheet against the photoreceptor surface 14. The copy sheet 12 is then transported on the photoreceptor surface 14 under a detacking corona generator 20 which substantially reduces the transfer charges thereon, preferably with an alternating current corona emission. The lead edge of the copy sheet 12 is then stripped from the photoreceptor surface 14 here by a mechanical stripping finger 24. (It will be appreciated that other stripping means may be provided). The position of the copy sheet lead edge 22 just as stripping is initiated as illustrated here by the dashed line position 22*a*.

As soon as the copy sheet lead edge 22 has been stripped from the photoreceptor surface 14, it is attracted to and guided over the generally planar, smooth stationary guide surface 26 here as shown in a bottom view of FIG. 3. It may be seen that it contains a plurality of vacuum apertures 30 capable of attracting and retaining the copy sheet 12 in intimate, shape conforming contact with the guide surface 26 as shown by the solid line position of the copy sheet 12.

The continuous electrostatic attachment of a (changing) intermediate segment of the copy sheet 12 behind its lead edge to the surface 14 provides a driving force for the copy sheet 12. The copy sheet is driven forward (downstream) at a velocity equal to that of the photoreceptor surface. The copy sheet 12 slides downstream over the guide surface 26, and past any further sheet guide members, such as the guide 32 shown here, toward the nip 34 of the roll fuser unit 36. The additional guide 32 would not be needed if the manifold guide surface 26 or an extension thereof extended sufficiently close to the fuser roll nip. In the solid line position of the copy sheet 12 illustrated in FIG. 1, the copy sheet is shown with its lead edge 22 just entering the fuser nip 34. It may be seen that in this position that the copy sheet 12 is fully engaged by and contiguous with substantially the entire guide surface 26 of the vacuum manifold unit 28.

Considering now some of the major areas of difference between the system 10 and prior systems of this type, the relationship of the driving velocity of the fuser nip 34 and the photoreceptor drum 16 will be discussed first. A common direct mechanical drive interconnection 38 is illustrated between the axis of one of the fuser rolls and the axis of the photoreceptor drum 16. However, rather than being designed to provide an equal surface velocity for the fuser roll nip 34 as that of the photoreceptor surface 14, the drive interconnection 38 is arranged with suitable difference pulley or gear diameters to provide a slightly slower speed for the fuser roll nip 34 than for the photoreceptor surface 14 in the transfer station. Thus, as the copy sheet 12 is advanced through the fuser nip 34, the lead edge 22 thereof is moving downstream at a slightly slower velocity than the intermediate and trailing areas of the same copy sheet as being advanced downstream by the photoreceptor surface 14. This would cause a potential force for slippage between the copy sheet 12 and the surface 14, which would cause toner image smears or skips, except that the system 10 provides means to allow the intermediate portion of the copy sheet 12, between the fuser roll nip and the transfer station, to form, with a low mechanical resistance, a buckle or bridge position away from the vacuum manifold unit guide surface 32. This buckle or bulge is allowed to freely expand out to a maximum position to take up or absorb the full accumulated speed differential of the entire copy sheet 12 until the trail edge 23 of the copy sheet is removed from the photoreceptor surface 14. This buckled or bridged position of the copy sheet 12 is illustrated by its dashed line position 12′ in FIG. 1. The leading and trailing edge positions of the copy sheet in its position 12′ are illustrated here respectively at 22′ and 23′. The buckle is always convex and expands further convexly as the copy sheet advances, relative to the fixed and generally planar guide surface 26. The loose toner image bearing side of the copy sheet faces away from the vacuum manifold 28.

Since in this system 10 the speed mismatch is compensated for by the buckle formed by the copy sheet backing up behind the slower fuser roll nip, and since the buckle expands away from the generally planar guide path 26, the buckles maximum dimensions can increase to compensate for an increase in speed mismatch, or decrease to compensate for a decrease in speed mismatch. Thus, the preset speed differential between the fuser roll nip and the photoreceptor surface is not critical and can vary during operation to accommodate for variations in the radius of the driven fuser roll, variations in the length of a copy sheet between its lead edge and trail edge, etc. The fuser roll nip velocity is preferably pre-set to always provide a somewhat slower speed (and therefore always provide a minimum buckle) sufficient to compensate for any normal machine operating latitude or changes, including those which would increase the nip velocity. This allows a fixed and uncritical fuser roll drive which does not have to be adjusted relative to the photoreceptor surface drive.

A sheet sensor 40 of a suitable or conventional mechanical switch (or photo-optical) type shown here provided in the path of the copy sheet 12 is an example of means providing an electrical signal indicative of the time at which the lead edge 22 of the copy sheet is first retained by the fuser roll nip 34. The switch 40 is shown in FIG. 1 positioned inside the vacuum manifold 28 with its switch actuating switch finger 41 extending through the bottom or guide surface 26. The finger 41 is normally in the copy sheet path and is adapted to be moved from the illustrated dashed line position to the illustrated solid line position by the passage of the lead edge 22 of the copy sheet 12. A time delay circuit 42 can be utilized to provide an electrical output signal after a time period corresponding to the time required for the lead edge 22 of the copy sheet to be driven from the position of switch finger 41 into the fuser nip. Various other switch locations along the copy sheet path may be utilized, of course. Alternatively, other available machine logic signals may be utilized instead, e.g., signals derived from a main cam bank or logic unit of the copier.

A controlled buckle is formed in the copy sheet without disturbing of the toner image and without exerting sufficient mechanical force on the copy sheet to cause slippage of the portion of the copy sheet on the photoreceptor surface 14. This is accomplished here by the novel construction and operation of the vacuum manifold unit 28. Referring initially to FIG. 2, it may be seen that the vacuum manifold unit 28 may comprise an integral metal casting or the like with a top cover 44 which is shown removed in FIG. 2 for clarity. An internal divider or vertical wall 46 extends the full length of the interior of the manifold to divide the manifold into two separate plenum chambers 48 and 49. The wall 46 extends approximately, but slightly downstream of, the mid-point of the lower guide surface 26 of the vacuum manifold and transverse the paper path. Both plenum chambers 48 and 49 have copy sheet retaining vacuum apertures 30 therein, although the upstream plenum chamber 48 preferably has a larger number and diameter of vacuum apertures than the downstream chamber 49, particularly along the initial upstream edge of the guide surface 26 where the copy sheet is initially held by the vacuum manifold unit. (Note FIG. 3).

As shown in FIG. 2, vacuum is applied to the vacuum manifold unit 28 from a single vacuum pump 50, which may be a simple axial fan or centrifugal blower motor unit. An appropriate vacuum level inside the vacuum manifold may be approximately 1½ inches of water, for example, or approximately 3.8 grams per square centimeter. With the arrangement here the vacuum pump 50 may be located at any desired position within the machine and connected by a vacuum conduit 52 to the rear wall of the vacuum manifold unit, for example. It is important to note, however, that the vacuum connection here is only to the upstream plenum chamber 48. The wall 46 is configured to isolate the vacuum input from the downstream plenum chamber 49. The only connection between the two plenum chambers, and therefore the only source of vacuum pressure for the upstream plenum chamber 49 here is through an air flow restrictive slot 54 centrally of the wall 46, as may be seen from the arrows indicating air flow patterns in FIG. 1.

With this vacuum arrangement, it may be seen that vacuum is maintained in the upstream plenum chamber 48 and, therefore, in the vacuum apertures 30 therein, at all times. This prevents the copy sheet from falling away or buckling away from the guide surface 26 of the vacuum manifold in the region of the upstream plenum chamber 48 at all times. Thus, the toner image bearing side of the copy sheet is prevented from contacting the stripper finger 24 or the photoreceptor surface 14 at any time and the paper path from the photoreceptor to the vacuum manifold is consistent. That is, after the initial lead edge stripping, the paper path between the area at which the body of the copy sheet strips from the photoreceptor and the vacuum manifold is constant and is maintained by the configuration and spacing of the upstream area of the vacuum manifold surface, since the copy sheet is maintained thereagainst at all times. Thus, shifting or changing of the stripping point of the copy sheet from the photoreceptor surface is prevented once the copy sheet lead edge has been captured by the vacuum manifold. This is important to prevent changes in the copy sheet charge level at stripping, since stripping occurs during detacking, under the detacking corona emissions generator 20.

In contrast, the vacuum within the downstream plenum chamber 49 is cyclically fluctuated during the machine operation with each copy sheet, as will be described. Specifically, the vacuum pressure in the plenum chamber 49 acting on the copy sheet is effectively removed during the time period in which it is desired to form the speed compensating buckle or bridge 12' in the copy sheet 12. That is, the vacuum force is removed from the vacuum apertures 30 in the downstream half of the vacuum manifold to allow the buckle to freely form in a controlled manner in that region, and downstream thereof, but not upstream thereof, with no vacuum force acting upon the sheet in its desired buckle region 12' during the formation of the buckle. Also, with this configuration the formation of the buckle is assisted by gravity, with the weight of the sheet in the buckle area tending to pull it downwardly away from the vacuum manifold 28 and any other guide 32. Thus, the formation of a buckle over a large area is pneumatically and mechanically unimpeded, and in fact is assisted. Yet the spread of the buckle region upstream is prevented by the continued retention of the downstream portion of the copy sheet against the vacuum apertures 30 in the upstream plenum chamber 48. Thus, the formation of the buckle in the copy sheet will not cause substantial slippage force to be generated or transmitted through the copy sheet upstream to that portion of the copy sheet in contact with the photoreceptor.

Referring to FIG. 1, the above-described cyclic removal of vacuum from the downstream plenum chamber 49 is accomplished here by a vent valve 56 rapidly operated by an electrical solenoid 58. Upon the receipt of an appropriately timed electrical signal, illustrated here by an electrical connection between the paper sensing switch 40 the time delay circuit 42 and the solenoid 58, the solenoid 58 operates to lift the vent valve 56 to its dashed illustrated position, thereby opening a vent opening 60 in the manifold top cover 44 to atmosphere (Note FIG. 2). This allows, as shown by the dashed airflow arrows in FIG. 1, ambient air to freely enter the downstream plenum chamber 49 and quickly drop the vacuum pressure therein to effectively zero. The vacuum connecting slot 54 through the wall of the wall 46 between the two plenum chambers continues to attempt to draw a vacuum therein, but this restrictive slot 54 is much smaller than the vent opening 60, and therefore is not capable of drawing a vacuum in the plenum chamber 49 when the vent opening 60 is opened by the vent 56. The relative proportions illustrated in the drawings are appropriate examples of these relative total areas, although the configuration, location and spacing thereof may be varied as desired.

Whenever the solenoid 58 is not actuated, i.e., as soon as the vent 56 is closed, a vacuum is applied from the vacuum blower 50 through the first plenum chamber 58 and the slot 54 in the wall 46 to draw a vacuum pressure level in the plenum chamber 49 comparable to that in the plenum chamber 48. The air flow path restriction provided by the slot 54, or other appropriate apertures between the two plenum chambers, is sufficiently restrictive in comparison to the total air flow provided by the vacuum pump 50 that the vacuum pressure in the plenum chamber 48 is not significantly affected by the sudden absence of vacuum in the plenum chamber 49 when the solenoid 58 is operated. However, a higher initial vacuum can, if desired, be provided in the front plenum chamber 48 for the same size blower, for providing a vacuum stripping assistance effect, for example.

When the copy sheet 12 covers the initial large vacuum holes 30 along the leading edge of the vacuum manifold, this reduces the air flow being drawn by the plenum chamber 48 through its vacuum holes 30. That allows an increase in the vacuum pressure available for the downstream plenum chamber 49 as the copy sheet moves theretoward from the area of the upstream plenum chamber 48, if so desired.

It is desirable to maintain full vacuum retention across the entire guide surface 26 of the vacuum manifold until the lead edge 22 of the copy sheet has been moved across the entire vacuum manifold and has entered the nip 34 of the fuser roll. It is particularly desirable to maintain a full vacuum holding force on the lead edge area of the sheet as it passes across the guide surface 26 of the downstream plenum chamber 49, particularly if this lead edge has a pre-set tendency to curl away from the manifold guide surface. Thus, the lead edge area of the copy sheet is fully supported from the photoreceptor until it is guided into the fuser. It is desired to remove the vacuum support from the copy sheet only after the lead edge of the copy sheet has been captured by, i.e., is supported in, the fuser nip 34. Also the speed mismatch problem does not begin to occur until the copy sheet reaches the fuser nip. The preferred planar configuration of the guide surface 26 here provides a smooth, unobstructed, linear path for the copy sheet 12 up to this point in its downstream movement, which is illustrated by the solid line position of the copy sheet 12 in FIG. 1.

When the lead edge 22 of the copy sheet 12 reaches the fuser nip 34, the vent valve solenoid 58 is rapidly actuated, venting the plenum chamber 49 to atmosphere, and allowing the copy sheet to drop or bow away from the bottom surface of that plenum chamber 49. Since the pre-set effective linear speed of the fuser rolls nip is slightly slower than that of the photoreceptor drum, the copy sheet therefor immediately begins to form a buckle to begin to absorb and accommodate this speed mismatch. However, as noted, the vacuum in the upstream plenum chamber 48 is maintained, so that the buckle forms only between the fuser roll nip and up to approximately the area of the vacuum separating wall 46.

This condition continues as the copy sheet feeds forward through the nip. That is, the solenoid 58 retains the vent 56 open, and the buckle 12 continues to expand until it reaches its maximum buckle position, which determined by the amount of speed mismatch which it must absorb and the length of the copy sheet being fed.

Then, as soon as the trail edge of the copy sheet 12 reaches its position 23', (i.e., as soon as the trail edge of the copy sheet has been removed from contact with the photoreceptor surface, and before the trail edge can pass beyond the supporting surface of the upstream plenum chamber 48) the solenoid 58 is deactivated to close the vent 56 and thereby restore vacuum pressure in the downstream plenum chamber 49. This insures that the trail edge area of the copy sheet will be retained against the guide surface 26 under the downstream plenum chamber 49, and will not be allowed to flip, fall away or kick back upstream, which could cause disturbance of the loose toner image thereon, i.e., the trailing copy sheet area is retained in its passage over the entire vacuum manifold unit 28.

It may be seen that vacuum support for the copy sheet even under the downstream plenum chamber 49 is removed only for the intermediate portion of the copy sheet in which the desired buckle is being formed, and not for either the leading or trailing portions of the copy sheet. If desired, the vacuum vent 56 may close even before the trail edge 23 of the copy sheet has completely left the photoreceptor surface, as long as the copy sheet has exited the transfer zone under the transfer corona generator 18. It may also be seen that this same cycle is repeated for every copy sheet.

The removal of the solenoid 58 signal to reclose the vent 56 in response to the stripping of the trail edge of the copy sheet from the photoreceptor can be controlled by a copy sheet trail edge sensor in the paper path connected to appropriate circuitry such as a time delay circuit 42 here. Alternatively, the time delay itself can be pre-set based on a machine setting signal responsive to the size of the copy sheets, in the paper path direction, being utilized.

A further feature disclosed herein relates to the different desired stripping positions of the lead edge of the copy sheet versus the main body of the copy sheet thereafter. A center line 62 is shown in FIG. 1 connecting the actual corona emitting element (wire) 21 of the detacking corona generator 20 with the center line and tangent line of the photoreceptor 16. As discussed above, the position of the lead area of the vacuum manifold unit and its angle relative to the photoreceptor surface 14 determines the angle and position of the copy sheet 12 relative to the photoreceptor surface and, therefore, provides the control for the actual stripping point or line at which the copy sheet first lifts away from the photoreceptor.

It has been found desirable that this stripping position occurs at or closely adjacent to the center line 62, i.e., at or directly adjacent the actual corona emitting element 21 of the detack corona generator 20 so as to be centrally of the ion emission area of the detack corona generator 20. The conductive shield 63 of the corona generator 20 provides an emission area into the copy sheet for a substantial and approximately equal distance on either side of the corona emitting element 21. Of course, the output distribution is non-uniform, i.e., the actual ion current output is higher as the corona emitting element is approached, since the corona emitting element is closest to the photoreceptor and has a higher field acting on it in that region. With stripping occuring under the detacking corona element, the stripping is occuring while the detacking process is still proceeding, i.e., before the full charge neutralizing effect has occurred, and while a substantial transfer charge still remains on the copy sheet from the upstream transfer corona generator 18.

However, it is important to note that this stripping point under the detacking corona generator electrode 21 is for the body of the sheet after the lead edge 22 has been stripped, not for the lead edge itself. As illustrated by the dashed line position 22*a* of the lead edge at the initial lead edge stripping point, this stripping point desirably occurs after the lead edge has passed the entire detacking corona generator 20 and has been subjected to the full detacking corona emission, so as to render the critical detacking of the lead edge easier by more fully removing the transfer charge therefrom. The stripper finger 24 is positioned immediately downstream of the detacking corona generator 20, and closely under the upstream (lead) edge of the vacuum manifold unit 28, which defines the downstream end of the detacking zone. The stripping edge is closely spaced from both the guide surface 26 and the downstream edge of the detacking corona generator 20, so that the smallest possible lead edge area of the copy sheet is subjected to the full detacking emissions. That is, the stripper rapidly moves the lead edge up to the manifold guide surface 26, and thereby moves the stripping point upstream to the desired location, before a significant area of the copy sheet has past beyond the detacking zone of the detacking corona generator 20.

It is important to note in this system 10 utilizing an under-speed fuser roll, that the vacuum manifold surface should assist in initially deforming the paper convexly. That is, the copy sheet configuration should be initially planar or slightly convex, because it is difficult to change the direction of a sheet buckle once it has been initiated in the opposite direction. A slight convexity or convex area in the vacuum guide surface 26 is helpful in initiating the paper buckle. The buckle in the copy sheet provides an additional advantage in that it increases the transverse beam strength of the copy sheet. This gives it added support from contacting hardware below the guide surface.

If necessary, the uppermost of the two rolls of the fuser roll unit 36 can be re-oriented by shifting its axis further around the other roller in a downstream direction than is shown. This provides additional space and a different orientation of the nip 34.

The entire integral unit disclosed here of a vacuum manifold together with the transfer and detack corotron units mounted thereto, is preferably mounted in the xerographic apparatus such a way as to be pivotable at one end yet maintainable in a fixed, pre-adjustable, spacing from the photoreceptor, as by a 3 point suspension system with conventional screw adjustable support pads on the machine framework. However, it will be appreciated that these three units may all be separately mounted if so desired.

If desired, one or both ends of the integral unit or individual units may instead be directly supported from the photoreceptor surface by low friction drum sliding or riding shoes or rollers resting against the edges of the photoreceptor surface, outside of the image utilized area. Photoreceptor drum riding supports are known for other processor units in xerographic copiers. For example, U.S. Pat. No. 3,918,403, issued Nov. 11, 1975, to R. C. Vock, teaches a transfer corona generator with a plurality of rollers contacting the back of the paper during transfer. U.S. Pat. No. 3,011,474, issued Dec. 5, 1961, to H. O. Ulrich teaches a photoreceptor roller mounted development electrode apparatus. A photoreceptor drum riding mounting arrangement allows the corona generator units and/or the vacuum manifold to be maintained at a pre-set constant spacing relative to the photoreceptor surface, irrespective of eccentricities or runout variations in the photoreceptor or its supports. However, the operating latitude of the present unit can accommodate normal such tolerances with a fixed mounting without requiring elimination of all relative movement between the unit and the photoreceptor.

It will be appreciated that vacuum may be selectively removed from selected areas of the vacuum manifold in other ways. For example, a sliding shutter could be utilized inside the bottom of the manifold to cover selected areas of the vacuum apertures in the sheet guide surface. With appropriate flow design this could also cause a selected increase in the vacuum pressure at the uncovered apertures, e.g., at the lead or stripping edge area.

It will be appreciated that the present invention may be utilized in many transfer and fusing system configurations other than those illustrated here. For example, additional sheet tensioning or movement dampening means may be provided as for example, those disclosed in U.S. Pat. No. 3,893,760, issued July 8, 1975, to R. R. Thettu. The system may be one utilizing a bias transfer roller instead of a corona generator, as shown by example in U.S. Pat. Nos. 3,781,105, issued Dec. 25, 1973, to T. Meagher, or 3,895,793, issued July 22, 1975, to J. J. Bigenwald, where closer spacing between the fuser rolls and the transfer roller is desired.

Various alternative stripping systems for the sheet lead edge may be utilized. For example, air puffers, vacuum strippers, or electrostatic detack with curvature of the photoreceptor for unassisted sheet beam strength stripping.

It will be noted with the embodiment disclosed herein that the copy sheet is supported by only a stationary or fixed guide member between the transfer station and the fusing station. This is advantageous in that rotating sheet transport members or belts with their additional mechanisms and expense are not required. The disclosed systems could also be applied to a copier in which the lead area of the unfused copy sheet is gripped by mechanical grippers, vacuum belts or rollers, or the like while a trail area of the same sheet is on the photoreceptor, (and the copy sheet is then subsequently fused in a radiant, flash or other type of fuser) by providing a similar buckle control interruptable vacuum guide surface for the non-unfused image side of the copy sheet. Also, while particularly applicable to preserving dry toner unfused images, the disclosed systems could also be utilized for liquid image systems in which wet (yet undried) images on copy sheets are being removed from an initial support surface.

In conclusion, it may be seen that there is disclosed herein an improved image transfer system. While the apparatus and steps disclosed herein are preferred, it will be appreciated that numerous variations and improvements may be made without significantly departing from the scope of the invention by those skilled in the art. The following claims are intended to cover all such variations and improvements as fall within the spirit and scope of the invention.

What is claimed is:

1. In a copying system in which an unfused image of imaging material is transferred from a moving initial image support surface means onto one side of a copy sheet while said copy sheet overlies the initial image support surface and moves therewith, and in which a lead area of the transferred unfused image-bearing copy sheet is then engaged by a moving sheet transport means spaced from the initial image support surface while a trail area of the same copy sheet is still moving with the initial image support surface, with the copy sheet extending therebetween, the improvement comprising:

speed control means for moving said initial image support surface and said sheet transport means at a pre-set speed differential for moving the lead area and the trail area of the same copy sheet at different speeds when said lead area of the copy sheet is engaged by said sheet transport means, vacuum guide surface means for vacuum supporting the copy sheet against a stationary vacuum guide surface from the side of the copy sheet opposite from the side bearing the transferred unfused image, said vacuum guide surface means being positioned between said initial image support surface and said sheet transport means for guiding the copy sheet therebetween, and vacuum control means cyclically actuable for reducing the vacuum applied to said vacuum guide surface in coordination with the extension of the copy sheet between said initial image support surface and said sheet transport means for movement of the copy sheet away from said vacuum guide surface by said pre-set speed differential from said speed control means for speed variation compensation;

wherein said vacuum guide surface means comprises at least first and second pneumatically discrete vacuum chambers with respective apertured surfaces providing pneumatically discrete first and second areas of said vacuum guide surface, wherein both of said vacuum chambers are provided with penumatic vacuum from a pneumatic vacuum generating means and said second vacuum chamber is controlled by said vacuum control means;

wherein said vacuum guide surface first area is adjacent said initial image support surface and vacuum support is maintained therethrough for the copy sheet without substantial reduction by said vacuum control means;

wherein said vacuum guide surface second area is further spaced from said image support surface than said first area and the copy sheet is vacuum retained thereagainst only when said vacuum control means is operative to maintain said vacuum support; and wherein said vacuum control means comprises an automatically actuated pneumatic valve for rapidly pneumatically venting said one vacuum chamber to atmosphere to rapidly reduce the vacuum therein.

2. The copying system of claim 1, wherein said two vacuum chambers are pneumatically interconnected by an air flow restrictive passageway therebetween, and wherein said first vacuum chamber is connected to said pneumatic vacuum generating means, and wherein said second vacuum chamber is penumatically connected to said vacuum generating means only through said restrictive passageway and said first vacuum chamber.

3. The copying system of claim 2, wherein said vacuum control means comprises an air vent opening to atmosphere in said one vacuum chamber spaced from said vacuum guide surface and a automatically actuated solenoid driven vent cover for said vent opening, and wherein said vent opening is substantially larger than said restrictive passageway.

4. The copying system of claim 1, wherein said first and second vacuum chambers are an integral unit internally divided by an internal central air flow separating wall.

5. The copying system of claim 1, wherein said vacuum control means is actuated to reduce the vacuum applied to said second vacuum chamber and second vacuum guide surface only while the trail area of the copy sheet is on the initial image support surface, and the vacuum is reapplied thereto upon the removal of the copy sheet from the initial image support surface.

6. The copying system of claim 1, wherein said sheet transport means is a rotatable roll fuser nip for fusing the unfused image on the copy sheet, and wherein said roll fuser nip is positioned closely adjacent said initial image support surface by a distance smaller than the dimensions of the copy sheet being fused in its direction of movement between the image support surface and the fuser roll nip.

* * * * *